US009422772B2

(12) United States Patent
Wilkinson

(10) Patent No.: US 9,422,772 B2
(45) Date of Patent: Aug. 23, 2016

(54) DRILL HEAD CLEAN OUT APPARATUS

(71) Applicant: PDI INCORPORATED, Elmhurst, IL (US)

(72) Inventor: Mitchell Wilkinson, Elmhurst, IL (US)

(73) Assignee: PDI INCORPORATED, Elmhurst, IL (US)

( * ) Notice: Subject to any disclaimer, the term of this patent is extended or adjusted under 35 U.S.C. 154(b) by 420 days.

(21) Appl. No.: 14/023,268

(22) Filed: Sep. 10, 2013

(65) Prior Publication Data

US 2015/0068807 A1 Mar. 12, 2015

(51) Int. Cl.
*E21B 12/06* (2006.01)

(52) U.S. Cl.
CPC ..... *E21B 12/06* (2013.01)

(58) Field of Classification Search
CPC ..... E21B 12/06; E21B 17/006; B08B 9/04; B08B 9/38; B23D 79/02; B23D 79/04
USPC ..... 175/84, 313
See application file for complete search history.

(56) References Cited

U.S. PATENT DOCUMENTS 3,835,941 A * 9/1974 King ..... 175/88
3,936,733 A * 2/1976 Clary ..... 324/262
4,364,701 A * 12/1982 Lynch ..... A01D 87/127 242/597.8
D379,997 S * 6/1997 Bailey ..... D15/32
5,833,424 A * 11/1998 Bales ..... A01D 87/127 414/24.5
6,848,883 B2 * 2/2005 Atencio ..... A01D 87/0076 414/24.5
6,907,874 B1 * 6/2005 Faircloth ..... 125/13.01
7,070,366 B2 * 7/2006 Reichenberger et al. ..... 408/76
7,614,463 B1 * 11/2009 Hunziker ..... 175/84
7,721,825 B2 * 5/2010 Gobright et al. ..... 175/57
2009/0178853 A1 * 7/2009 Pavlik ..... 175/84
2010/0024515 A1 * 2/2010 Hough ..... B21F 1/002 72/458

OTHER PUBLICATIONS

Pre-Sep. 2013 vertical shaft welded to trench plate, 1 page.

* cited by examiner

*Primary Examiner* — Robert E Fuller
(74) *Attorney, Agent, or Firm* — McDonnell Boehnen Hulbert & Berghoff LLP

(57) ABSTRACT

A drill head clean out device having a clean out tool, a first bar having a first end and a second end, wherein the clean out tool is adapted to be positioned on the first end of the first bar, a coupling member having a first aperture adapted to receive the first bar when the first bar is in a vertical orientation, a second bar having a first end and a second end, wherein the coupling member has a second aperture adapted to receive a first end of the second bar when the second bar is in a horizontal orientation, and wherein the second end of the second bar is adapted to be positioned within an aperture in a base of a drill rig.

23 Claims, 12 Drawing Sheets

DRILL HEAD CLEAN OUT APPARATUS

BACKGROUND

The present application generally relates to drilling devices for drilling holes in the ground. More particularly, the present application relates to a device that may be used to clean out debris, dirt, or clay that collects inside of a drill head during the drilling process. The present application is particularly useful as a clean out device for removing clay, dirt, or debris that collects inside a drill head that may be used for drilling holes in a landfill.

Landfills are used to store the vast majority of municipal solid waste generated in the United States. In fact, there are thousands of such landfills throughout the country. Landfill gas is produced by the chemical reactions and microbes during the decomposition of the waste material. The landfill gas typically contains methane gas, which is a combustible gas. As the landfill gas increases, the pressure and quantity of landfill gas may create a dangerous condition. As a result, holes are drilled into the landfill that are used to monitor the landfill gas or vent the landfill gas where it can be flared or "burned off." In addition, in recent years efforts have been made to harness the gas produced in the landfill and use the gas as an energy source. Therefore, there are a number of reasons why holes are required to be drilled in a landfill.

The holes are typically drilled using a mobile drill rig, such as a drill rig based on a tractor or truck. A drill head or drill bucket is used to drill and remove the landfill materials as the hole is being formed. The holes may be of various sizes. For example, holes are typically in the range of 24-48 inches in diameter, with a 36 inch diameter hole being fairly common. However, in some applications holes 6 feet or more in diameter may be required. The drill head or drill bucket is typically formed as a hollow cylinder having a plurality of cutting teeth located on a periphery of the bottom of the drill head. The drill head is rotated and the cutting teeth drill into the landfill until the generally open interior of the drill head becomes filled with the debris from the landfill. The drill head is removed from the hole and the debris within the interior of the drill head is emptied from the drill head. The process is repeated until the hole reaches a desired depth.

Drilling holes in a landfill presents a number of problems. Many different types of materials are encountered in the solid waste of a landfill. For example, plastic bags, household waste, tree branches, and rebar may be encountered. This debris may become caught within the interior of the drill head and must be removed before the drilling operation can continue. Furthermore, landfills often contain clay, which may be used as a cover barrier or to absorb leachate in the landfill. Clay poses the additional problem of "sticking" to the interior of the drill head. Thus, removal of the landfill debris and/or clay from the drill head is an important aspect of the drilling operation.

In the past, a variety of different approaches to removing the landfill debris and/or clay from the drill head have been used. For example, drill rig operators have tried to "shake" the debris and/or clay loose by raising and then lowering the drill head with an abrupt stop, or by rotating the drill head back and forth with abrupt reversals. Another approach has been to swing the drill head back and forth to try to loosen the debris and/or clay from the drill head. These approaches may not work, or may only partially work, leaving some debris and/or clay stuck within the drill head. However, even if these approaches do work, they result in undesirable wear and fatigue on the components of the drill rig. For example, the slewing ring between the operator cab and the base of the drill rig may undergo undesirable wear and tear that shortens its lifespan, or the Kelly bar typically attached to the drill head may undergo fatigue and stress that limits its useful lifespan. The cost of replacing or repairing the Kelly bar can be in the tens of thousands of dollars.

Recognizing that various manipulations of the drill rig in an attempt to loosen and remove the debris and/or clay within the drill head may not be effective and result in undesirable wear on the drill rig components, other methods of removal have been attempted. For example, a vertical bar welded to a large steel trench plate has been constructed. To clean out the drill head, the drill head is lowered onto the vertical bar so that the vertical bar is positioned within the interior of the drill head, and then the drill head is rotated in an attempt to remove the debris and/or clay from the drill head. The vertical bar contacts the debris and/or clay as the drill head is rotated and may knock loose some of the debris or clay within the drill head. However, the vertical bar can often get "hung up" on the debris and/or clay. When this happens the force of the rotating drill head (created by the over 50,000 foot/pounds of torque that may be provided by the drill rig) is transferred to the vertical bar, and in turn to the large trench plate causing the vertical bar and large trench plate to rotate together with the drill head.

Another approach has been to pound or screw a vertical bar into the landfill. However, when using this technique when the vertical bar gets "hung up" on the debris and/or clay, the force of rotating the drill head may cause the vertical bar to become loose from the ground and wobble as the vertical bar rotates together with the drill head.

Cleaning out the drill head is an important part of the process of drilling holes in a landfill. When a drill rig operator is unable to remove the debris and/or clay from the drill head, no drilling can occur, resulting in costly downtime. Therefore, there is a need to provide a method and/or device that may be used to clean out the drill head that does not require excessive manipulation of the drill rig and that does not include an apparatus that rotates together with the drill head when the clean out tool gets "hung up" in the interior of the drill head.

SUMMARY

In one aspect, a drill head clean out apparatus is provided having a clean out tool, a first bar having a first end and a second end, wherein the clean out tool is adapted to be positioned on the first end of the first bar, a coupling member having a first aperture adapted to receive the first bar when the first bar is in a vertical orientation, a second bar having a first end and a second end, wherein the coupling member has a second aperture adapted to receive a first end of the second bar when the second bar is in a horizontal orientation, and wherein the second end of the second bar is adapted to be positioned within an aperture in a base of a drill rig.

In a further aspect, a drill head clean out apparatus is provided having a drill rig having a base, with an aperture in the base, a first bar having a first end and a second end, a clean out tool positioned on the first end of the first bar, a coupling member retaining the first bar, wherein the first bar extends upwardly from the coupling member, a second bar having a first end and a second end, wherein the coupling member retains the first end of the second bar; and wherein the second end of the second bar is positioned within the aperture in the base of the drill rig.

In a further aspect, a method of cleaning out a drill head is provided having the steps of providing a drill rig having a base, with an aperture in the base, a first bar having a first end and a second end, a clean out tool positioned on the first end of the first bar, a coupling member retaining the first bar, wherein the first bar extends upwardly from the coupling member, a second bar having a first end and a second end, wherein the coupling member retains the first end of the second bar, wherein the second end of the second bar is positioned within the aperture in the base of the drill rig; positioning a drill head such that the clean out tool is positioned within an interior of the drill head; rotating the drill head to clean out debris or clay within the interior of the drill head; and preventing rotation of the drill clean out apparatus while the drill head is rotating by the positioning the second end of the second bar within the aperture in the base of the drill rig.

In addition, the embodiments also disclose means for preventing rotation of the drill head clean out apparatus when the clean out tool is positioned within the interior of the drill head and the drill head is being rotated.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Figure 1:
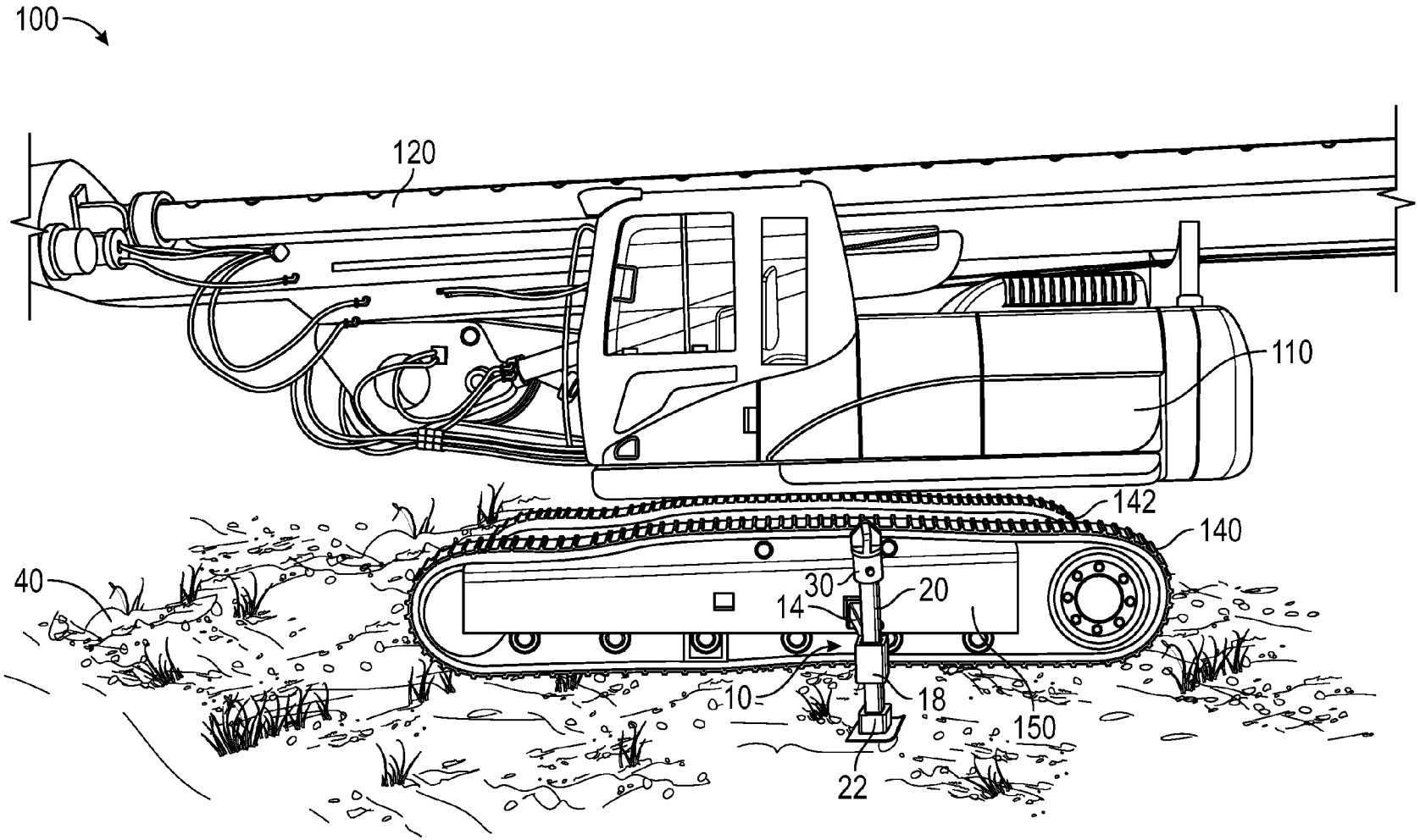
FIG. 1 is a perspective side view of drill head clean out apparatus 10 coupled to drill rig 100, according to an example embodiment.

The present embodiments are directed to a drill head clean out apparatus that operates in conjunction with a drill rig. As noted above, mobile drill rigs are often used to drill holes in a landfill. The weight of the drill rig may be well over 50,000 pounds, and commonly used drill rigs may be 90,000 pounds or more. The disclosed drill head clean out apparatus embodiments advantageously use the weight of the drill rig to prevent the drill head clean out apparatus from rotating together with the drill head when the clean out tool gets "hung up" within the interior of the drill head.

As used herein the term "drill rig" is to be construed broadly to include mobile drill rigs, such as a drill rig where the drilling apparatus is supported on a truck or tractor, or a trailer, as well as stationary drill rigs that are capable of being moved from one location to another. The drill rigs are provided with a base, which may be the vehicle frame on a truck or trailer, or the frame about which the track rotates in the case of a tractor. The base of the drill rig supports (indirectly) the drill head that is used for drilling a hole. The base of the drill rig is provided with an aperture that in a preferred embodiment extends into an undercarriage of the drill rig.

The drill head clean out apparatus includes a first bar that extends in a vertical orientation and has a clean out tool positioned on an upper end of the first bar. The first bar extends into a coupling member which is used to retain the first bar, and preferably includes an aperture that encloses a portion of the first bar. The first end of a second bar is secured to the coupling member and extends in a horizontal orientation where the second end of the second bar is positioned within the aperture in the base of the drill rig. As used herein the term "vertical orientation" does not require the first bar to be absolutely vertical, only that it extends in a direction that is more vertical than horizontal. Similarly, the term "horizontal orientation" does not require the second bar to be absolutely horizontal, only that it extends in a direction that is more horizontal than vertical.

In order to clean out the drill head, the drill head is positioned over the clean out tool and then lowered so that the clean out tool is positioned within an interior of the drill head. The drill head is then rotated. As the drill head rotates the clean out tool removes debris and/or clay from within the interior of the drill head. The clean out tool is prevented from rotating together with the drill head because the second end of the second bar is positioned within the aperture in the base of the drill rig. In order for clean out tool to rotate together with the drill head (as happens in prior designs when the clean out tool gets "hung up" within the drill head), the base of the drill rig would have to be rotated as well, given that the clean out tool is indirectly attached to the base of the drill rig. It will be appreciated that given the various connections between the components of the drill head clean out apparatus, the term "preventing rotation" or "to prevent rotation" does not require that there is no rotation of any portion of the drill clean out apparatus, rather it means that the drill head clean out apparatus is prevented from rotating more than 90 degrees.

Example embodiments are shown in FIGS. 1-11. FIG. 1 is a perspective side view of drill head clean out apparatus 10 coupled to drill rig 100. In this embodiment, drill rig 100 is a tractor style drill rig having a base 150 and tracks 140 and 142. An operator cab 110 is part of base 150 and positioned above tracks 140 and 142 and rotates relative to a lower part of the base 150. Drill component 120 is supported above base 150. As used herein the term drill rig "base" shall be broadly construed and includes the components of the drill rig that are positioned beneath the drilling components, such as the vehicle frame, chassis, tracks, operator cab, etc.

Drill head clean out apparatus 10 is shown positioned adjacent base 150 with bar 14 extending horizontally from base 150 and secured to coupling member 18. Clean out tool 30 is positioned on top of bar 20 that extends upwardly from coupling member 18. A base 22 is provided on the bottom of bar 20 that may be positioned on ground 40, although a base is not required.

Figure 2:
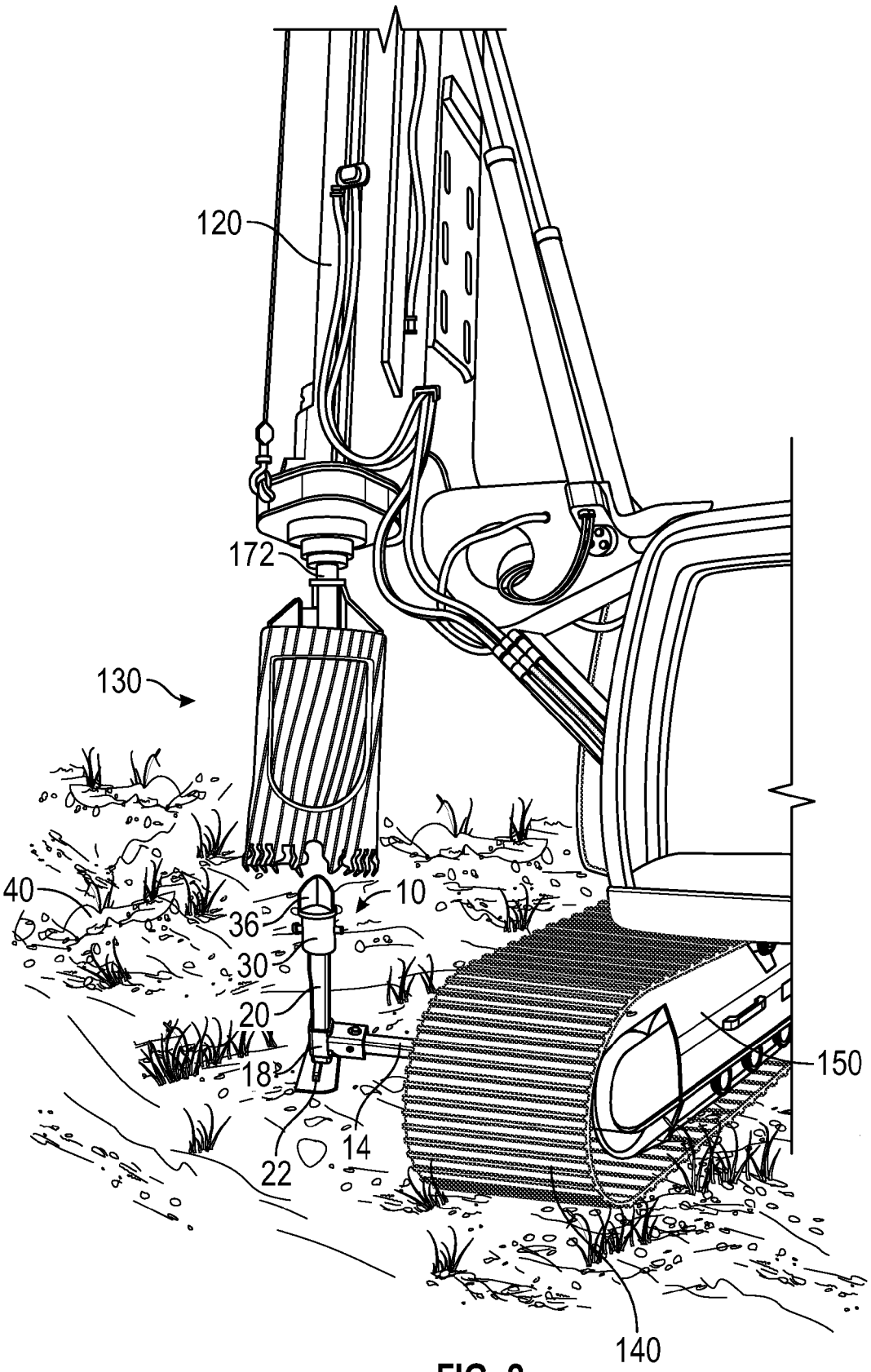
FIG. 2 is a perspective view of drill head 130 positioned above drill head clean out apparatus 10 shown in FIG. 1, according to an example embodiment.

FIG. 2 is a perspective view of drill head 130 positioned above drill head clean out apparatus 10 shown in FIG. 1. Drill head 130 is shown connected to drill component 120 via bar 172. Bar 172 may be what is referred to as a Kelly bar, which may be a solid square steel bar commonly used in the drilling process. Drill head clean out apparatus 10 is shown with bar 14 extending horizontally from base 150 positioned within track 140 and into coupling member 18. Bar 20 extends vertically from base 22 and clean out tool 30 is positioned on top of bar 20.

Figure 3:
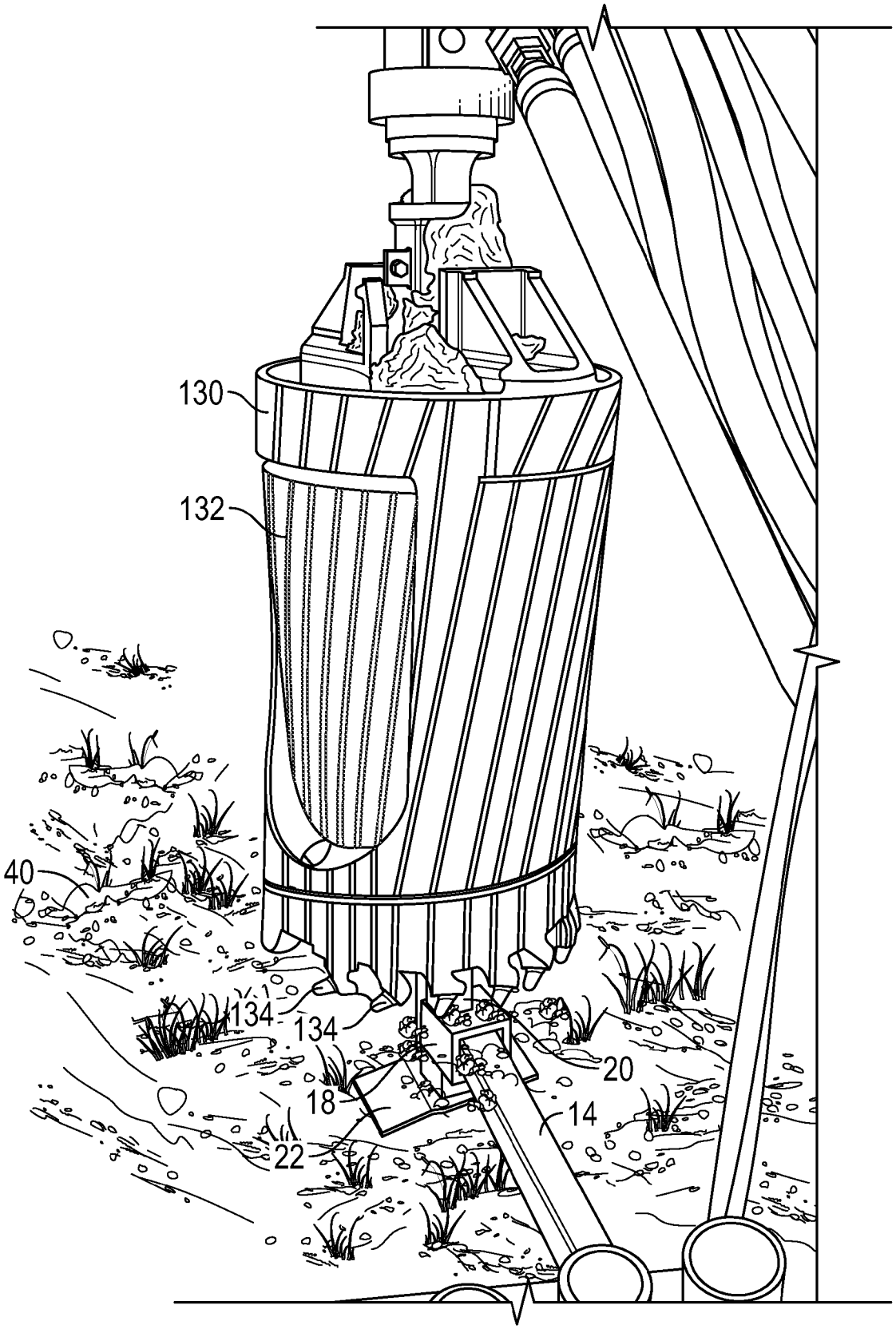
FIG. 3 is a perspective close up view of drill head 130 lowered onto drill head clean out apparatus 10 shown in FIGS. 1 and 2.

FIG. 3 is a perspective close up view of drill head 130 lowered onto drill head clean out apparatus 10 shown in FIGS. 1 and 2. Drill head 130 includes teeth 134 that are used to cut into the landfill during the drilling operation. Drill head 130 also includes doors, including door 132, that may be moved inwardly to hold debris within the interior drill head 130 as drill head 130 is removed from the hole. The drill head 130 is moved to a desired location to dump the debris removed from the hole, and then the doors are moved outwardly to allow the debris to fall from drill head 130. In FIG. 3, the door 132 is in its open position and drill head 130 has been lowered onto the drill head clean out apparatus 10 shown in FIGS. 1 and 2. Bar 14 is shown extending horizontally from coupling member 14, plate 22 is positioned on the ground 40 and bar 20 is extending vertically into the interior of drill head 130.

Figure 4:
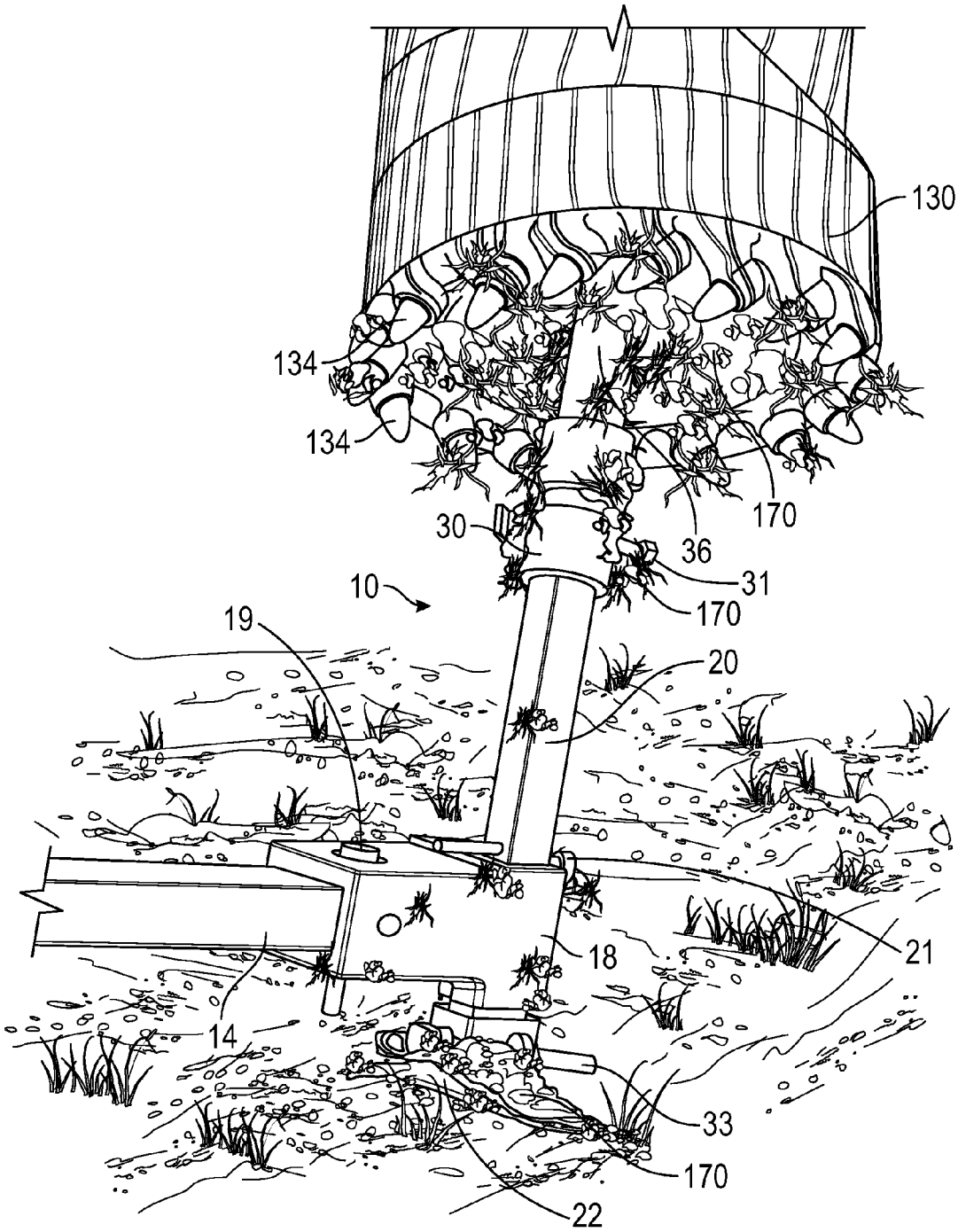
FIG. 4 is another perspective view of drill head 130 positioned over drill head clean out apparatus 10 shown in FIGS. 1-3.

FIG. 4 is another perspective view of drill head 130 positioned over drill head clean out apparatus 10 shown in FIGS. 1-3. Teeth 34 are shown around the lower periphery of drill head 130. Drill head 130 has been lowered onto top end 36 of clean out tool 30 that is used to clean out debris and/or clay 170 positioned within the interior of drill head 130. Pin 31 is shown that is used to removably secure clean out tool 30 to vertically extending bar 20. Bar 20 is retained within coupling member 18. A pin 21 extends through bar 20 and rests atop coupling member 18 and may be used to position clean out tool 30 a desired distance above the ground. In addition, pin 19 is shown extending through coupling member 18 and bar 14 to removably secure bar 14 to coupling member 18. Furthermore, pin 33 is used to removably secure plate 22 to the bottom of bar 20.

Figure 5:
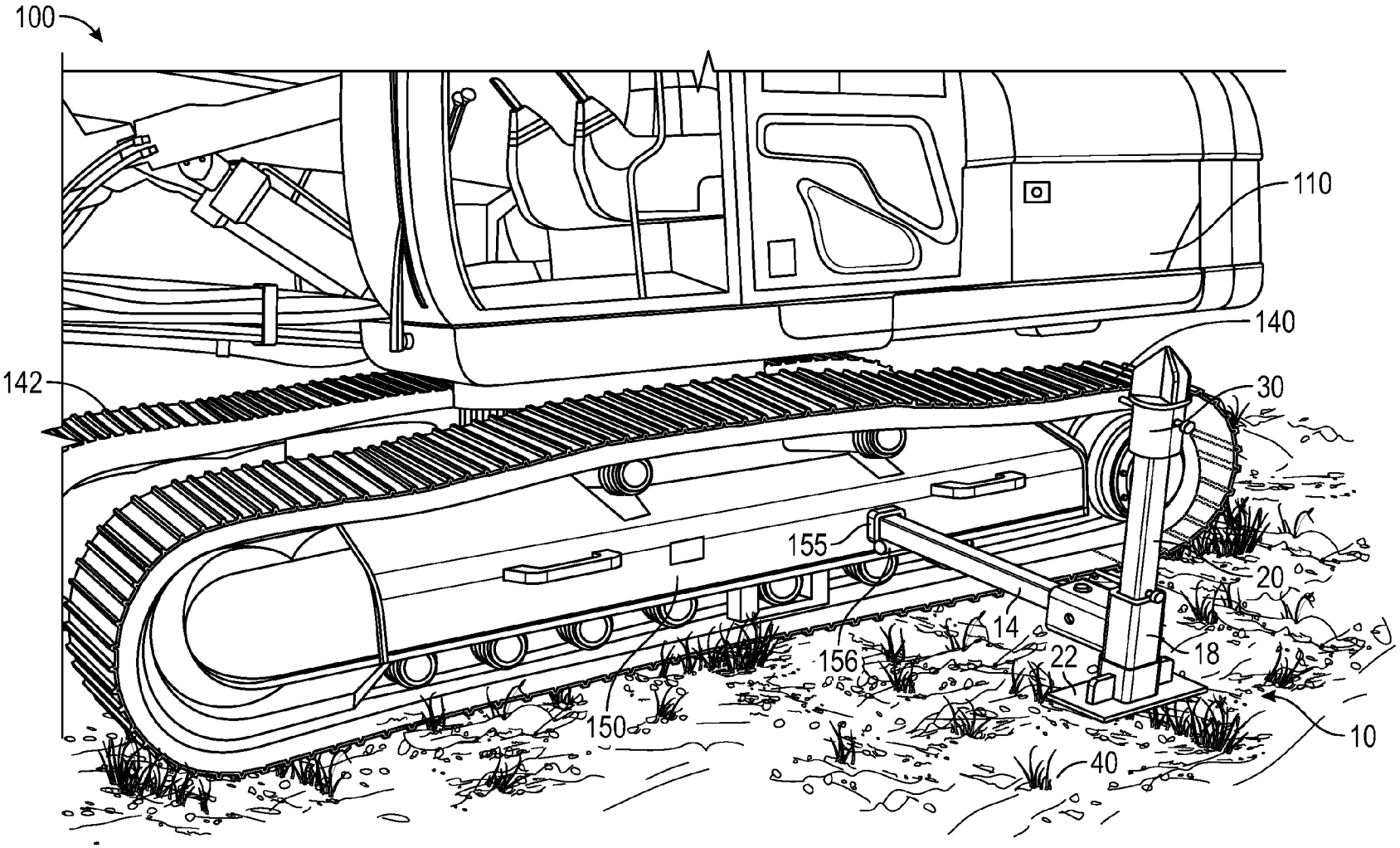
FIG. 5 is a perspective view of bar 14 of drill head clean out apparatus 10 positioned in an aperture in base 150 of drill rig 100, according to an example embodiment.
Figure 6:
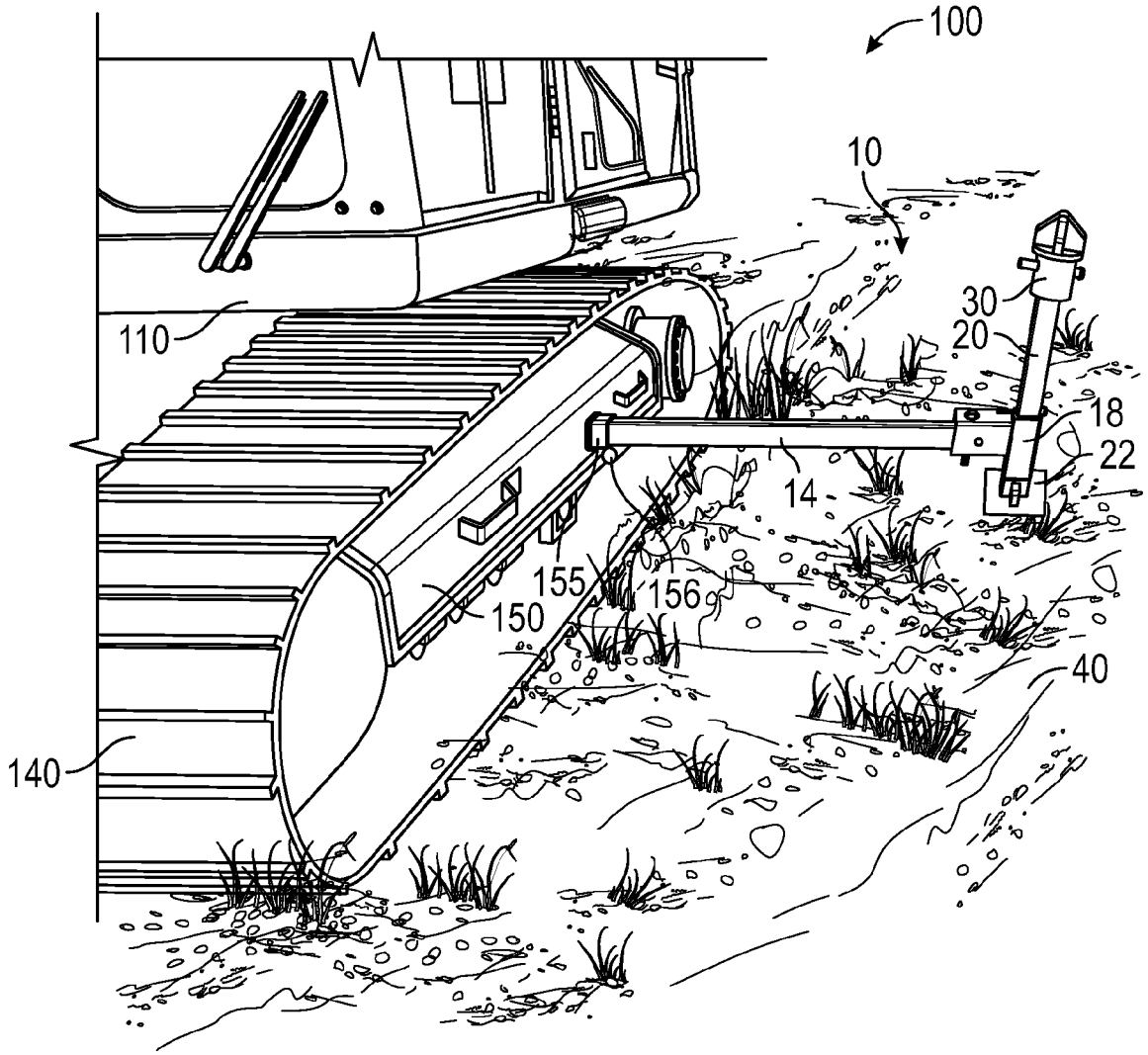
FIG. 6 is a another perspective view of bar 14 of drill head clean out apparatus 10 positioned in an aperture in base 150 of drill rig 100 shown in FIG. 5.

FIGS. 5 and 6 are perspective views of bar 14 of drill head clean out apparatus 10 positioned in an aperture in base 150 of drill rig 100 shown in FIG. 1. Operator cab 110 is part of base 150 and positioned above tracks 140 and 142. Drill head clean out apparatus 10 is shown positioned adjacent base 150 with bar 14 extending horizontally from base 150 and secured to coupling member 18. Clean out tool 30 is positioned on top of bar 20 that extends upwardly from coupling member 18. A base 22 is provided on the bottom of bar 20 that may be positioned on ground 40. However, in FIGS. 5 and 6, the base is pulled up into contact with coupling member 18 and is not in contact with the ground 40. The drill head clean out apparatus 10 may be used to clean out the interior of a drill head when the plate 22 is positioned above the ground 40. Furthermore, when it is time to move to a new location to drill a new hole, the bar 20 may be advantageously moved into the position shown in FIGS. 5 and 6 so that the base 22 does not drag along the ground during movement of drill rig 100 to a new location.

A hollow member 155 is shown extending from base 150 of drill rig 100. The second end of bar 14 is designed to extend into the aperture within hollow member 155. A rolling member 156 may be positioned at the lower entrance to the aperture of hollow member 155 to facilitate movement of bar 14 into and out of the hollow member 155. Another rolling member may be positioned above the entrance on the opposite side of hollow member 155 that also facilitates the movement of bar 14 into and out of hollow member 155. The hollow member 155 may be comprised of a square tube adapted to receive bar 14. The hollow tube 155 may extend all the way through base 150 and hollow member 155 into the undercarriage of drill rig 100.

In a preferred embodiment, bar 14 is comprised of Kelly bar that has a square cross section. The Kelly bar may be a solid steel bar comprised of 4140 heat treated and tempered steel. In a preferred embodiment, the bar 14 may have a 3½×3½ inch cross section. Bar 20 also may have the same construction as bar 14 and be made from Kelly bar having a 3½×3½ inch cross section. This size Kelly bar has proven to provide sufficient strength to be suitable for use as bars 14 and 20 in drill head clean out apparatus 10. However, different size bar stock may be used for bars 14 and 20 having different size and shape cross sections as desired. For example, bars having rectangular, hexagonal or even round cross section could be used for bars 14 and 20, although a square cross section is preferred. In additions, bars 14 and 20 could also be hollow. In addition, bars 14 and 20 are not required to be a continuous member, and may be formed of a number of different components. For example, bars 14 and 20 could take the form of a truss having various members welded or connected together to form bars 14 and 20. Hollow member 155 may be made of five inch square tube having ¾ inch thick walls that is available from Timken.

Figure 7A:
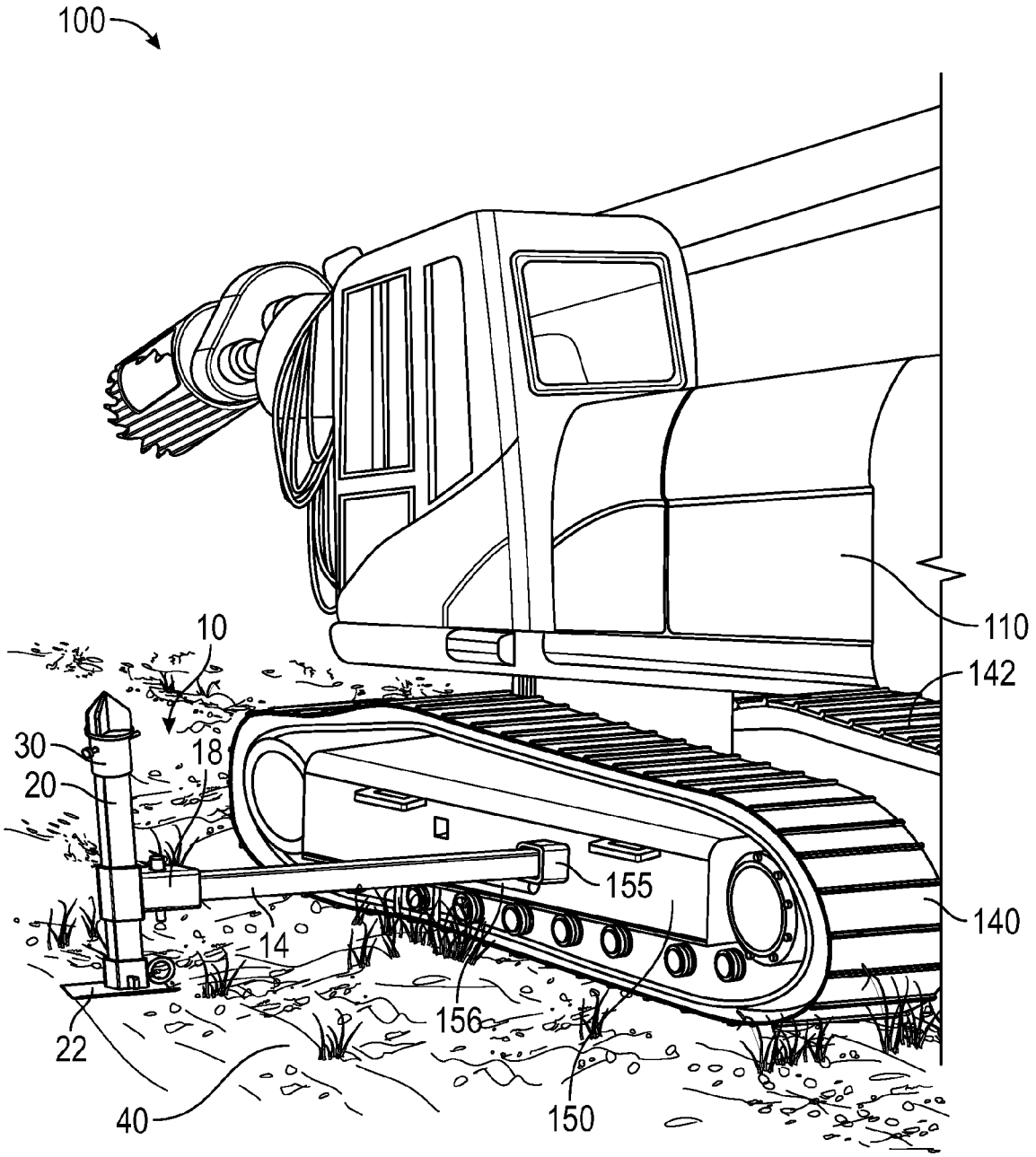
FIG. 7A is another perspective view of bar 14 of drill head clean out apparatus 10 positioned in an aperture in base 150 of drill rig 100 shown in FIGS. 5 and 6.

FIG. 7A is another perspective view of bar 14 of drill head clean out apparatus 10 positioned in an aperture in hollow extension 155 in base 150 of drill rig 100 shown in FIGS. 5 and 6. Operator cab 110 is part of base 150 and positioned above tracks 140 and 142. Drill head clean out apparatus 10 is shown positioned adjacent base 150 with bar 14 extending horizontally from base 150 and secured to coupling member 18. Clean out tool 30 is positioned on top of bar 20 that extends upwardly from coupling member 18.

Figure 7B:
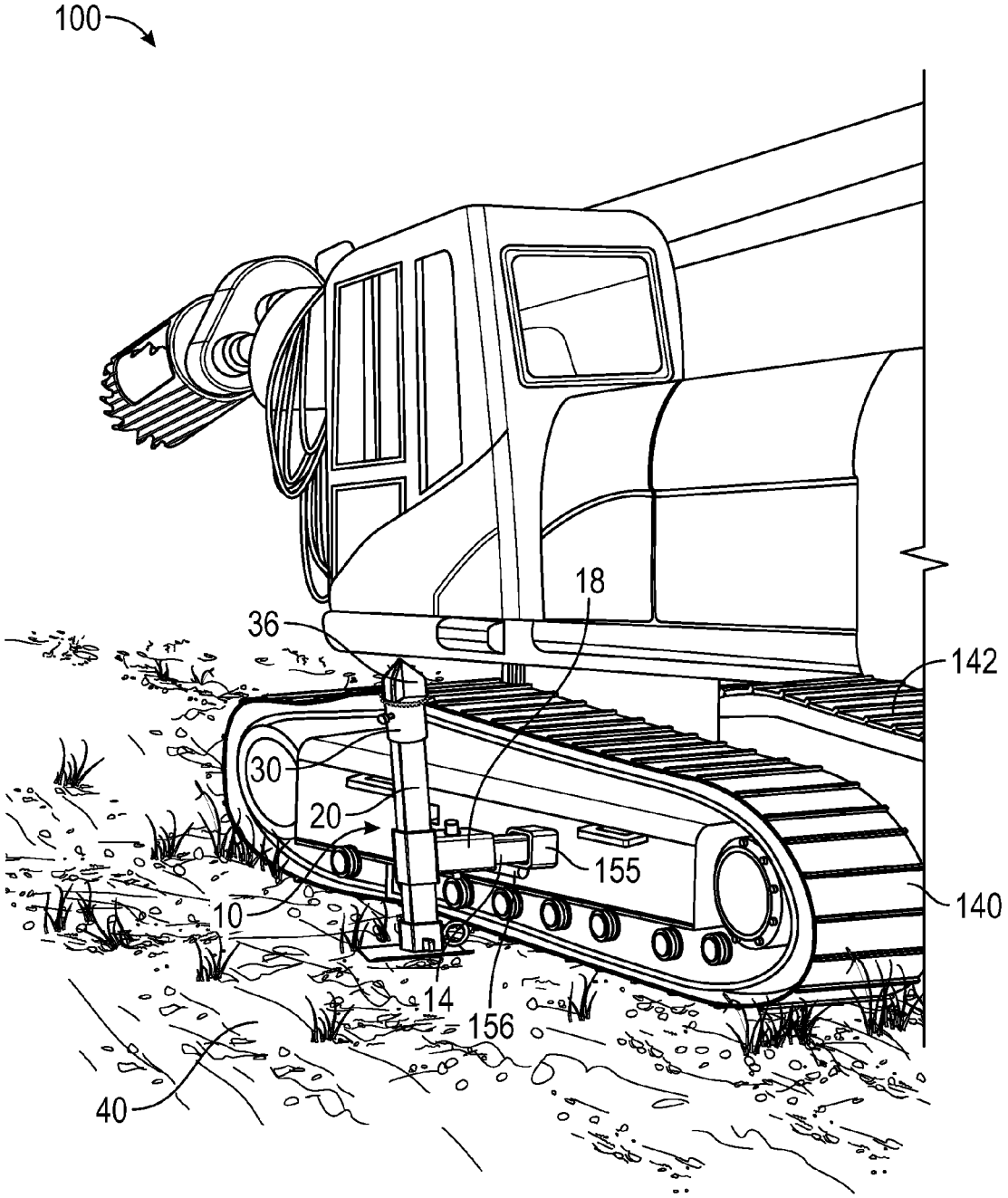
FIG. 7B is a perspective bottom view of bar 14 of drill head clean out apparatus 10 positioned in an aperture in base 150 of drill rig 100 as shown in FIG. 7A, after the bar 14 has been moved into the undercarriage of drill rig 100 so that clean out tool 30 is positioned close to the base 150.

FIG. 7B is a perspective bottom view of bar 14 of drill head clean out apparatus 10 positioned in an aperture in base 150 of drill rig 100 as shown in FIG. 7A, after the bar 14 has been moved into the undercarriage of drill rig 100 so that clean out tool 30 is positioned close to the base 150. By moving the second end of bar 14 into the undercarriage of drill rig 10, the drill head clean out tool 10 may be more easily transported to a new location. Of course, base 22 is preferably positioned above ground 40 during transport.

It will be appreciated that the aperture in base 150 into which bar 14 extends is not required to extend all the way through the base 150. However, in a preferred embodiment the aperture extends all the way through base 150 so that the second end of bar 14 may be moved into the undercarriage of drill rig 100 as shown in FIG. 7B. A flange or another hollow extension may also be positioned on the inside of the base positioned with track 142 when bar 14 is positioned in the undercarriage of drill rig 100 that may be used to support or retain the second end of bar 14 within the undercarriage.

Figure 8A:
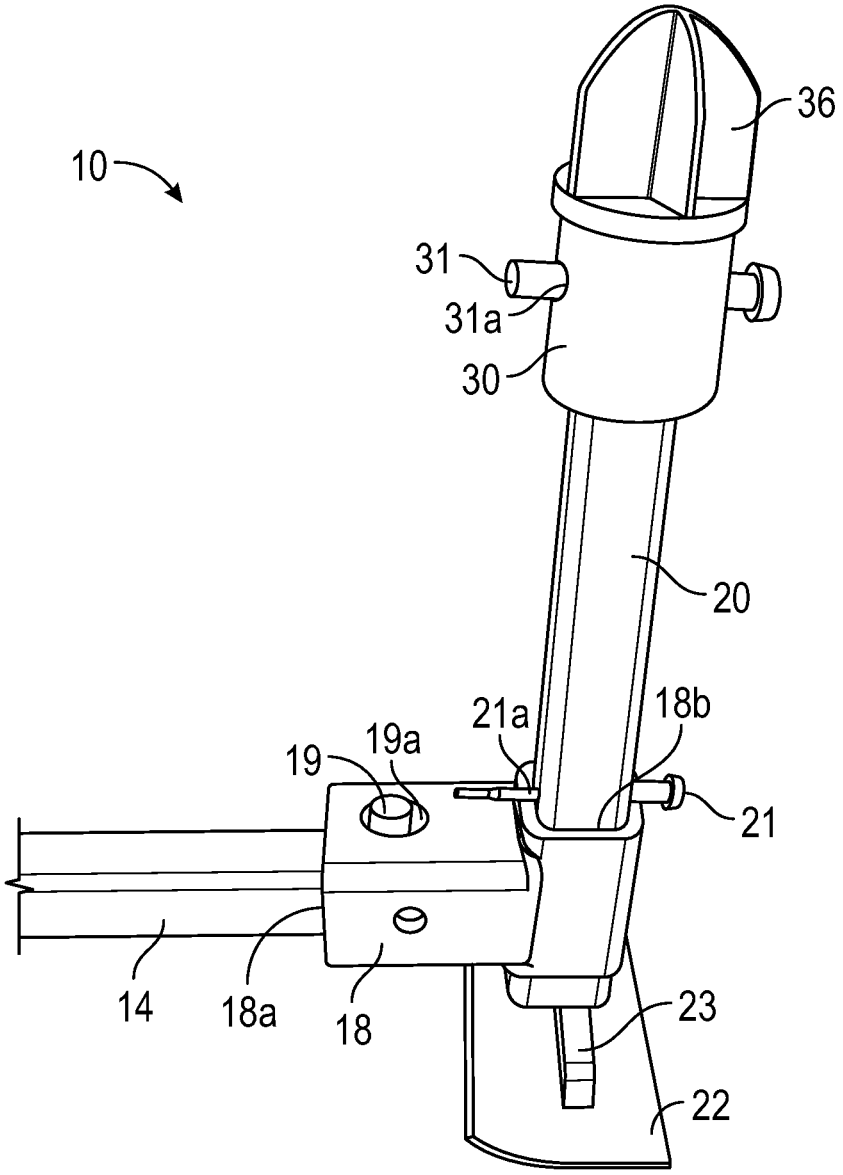
FIG. 8A is a perspective view of drill head clean out apparatus 10 with end 36 of clean out tool 30 having a certain geometry, according to an example embodiment.

FIG. 8A is a perspective view of drill head clean out apparatus 10. Coupling member 18 has an aperture 18*b* that retains bar 20 and through which bar 20 extends. As noted above, bar 20 preferably has a square cross section. Aperture 18*b* of coupling member 18 is preferably made of a hollow square tube have an inner diameter slightly larger than the outer diameter of bar 20, which in a preferred embodiment is 3½ inches. The square inner shape of aperture 18*b* closely matches the outer shape of bar 20 and thereby prevents bar 20 from rotating within aperture 18*b* when clean out tool 30 and end 36 are positioned within the interior of a drill head and the drill head is rotated.

It will be appreciated that bar 20 extends all the way through aperture 18*b* in FIG. 8A, and thus aperture 18*b* extends all the way through coupling member 18. However, aperture 18*b* is not required to extend all the way through. For example, the end of bar 20 could be retained within aperture 18*b* and positioned above a base located in aperture 18*b*. Thus the term "aperture" as used herein does not require a hole that extends all the way through, and an aperture may or may not extend all the way through a given member.

Moreover, although apertures 18*a* and 18*b* are shown being enclosed by material of coupling member 18 on all sides, that is not required. For example, an aperture may be only partially enclosed. In this regard, the aperture in base 150 into which second bar 14 extends could be formed as an extension attached to the base 150. For example a plate with having walls could be attached to the plate (perhaps by welding) and the second bar 14 could extend between the walls on the extension, in which case the walls on the extension would be considered an "aperture." The walls could be hinged to the plate or base 150 so that the second bar 14 could be rotated from a first, operational position perpendicular to the base 150 to a second, stowed position where the second bar 14 is parallel to the base 150. In this manner, the drill head clean out apparatus 10 could be moved to the second, stowed position during movement of drill rig from one hole site to the next.

Similarly, it will be appreciated that bar 14 does not extend all the way through aperture 18*b* as shown in FIG. 8A. However, it is possible that aperture 18*b* extends all the way through coupling member 18. For example, bar 14 could extend all the way through aperture 18*b* and extend beneath the second end of bar 20.

Accordingly, the term "aperture" as used herein does not require a hole that extends all the way through the coupling member 18 or the base 150, and an aperture may or may not extend all the way through a given member. Furthermore, given that bar 14 and bar 20 may be positioned within or extend through apertures 18*a* and 18*b* respectively, an end of a bar may be "received" within an aperture if it is positioned within the aperture or has been extended through the aperture.

In FIG. 8A, a pin 19 extends through hole 19*a* on coupling member 18 into an aperture on the first end of bar 14 to removably secure bar 14 to coupling member 18. Pin 19 may, but is not required to, extend all the way through bar 14. Similarly, pin 31 extends through hole 31*a* and into the first end of bar 20 to removably secure clean out tool 30 to bar 20. However, other means of removably securing those components together could be used. For example, clean out tool 30 could be threaded onto bar 20, or clamped to bar 20, and similarly bar 14 could be threadingly secured to coupling member 18, or clamped to coupling member 18. Any suitable method of securing two parts to one another could be used.

In addition, it is also possible that bar 14 is permanently secured to coupling member 18. For example bar 14 could be welded to coupling member 18. As used herein, the term "secured to" includes components that are removably or permanently secured to each other. Similarly, first bar 20 is shown removably retained within aperture 18*b* of coupling member 18 in FIG. 8A. It is also possible that bar 20 is permanently retained within aperture 18*b* of coupling member 18, perhaps by welding. As used herein, the term "retained" includes both temporary and permanent retention. Moreover, as used herein, two components may be "secured" to each other either directly or indirectly. Similarly, one part may "retain" another part either directly or indirectly. Furthermore, it is possible that bar 14 could be permanently secured directly to bar 20. In such a case, the "coupling member" is any component(s) used to secure bar 14 to bar 20. In the case of bar 14 being welded directly (or indirectly) to bar 20, the "coupling member" would comprise the welding material.

In FIG. 8A, clean out tool 30 is shown removably secured to bar 20 with pin 31. However, it is also possible that clean out tool 30 is integrally formed with bar 20. Thus, clean out tool 30 could be a machined or formed first end of bar 20, or even simply be the first end of bar 20.

In FIG. 8A, end 36 of clean out tool 30 is shown having a having a certain geometry shown in the above Figures. However, the end of the clean out tool may have any number of different geometries. For example, certain geometries may be more well-suited for a particular type of material encountered during drilling a hole in the landfill.

Figure 8B:
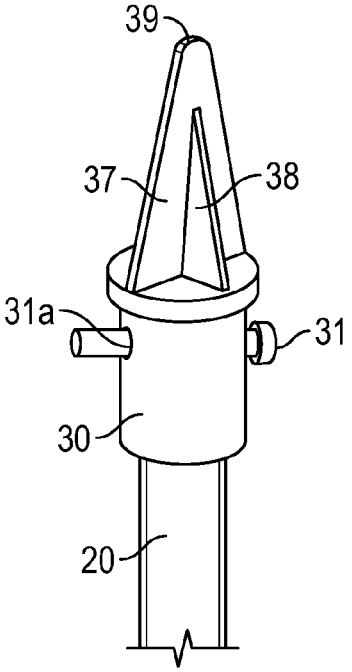
FIG. 8B is a perspective view of clean out tool 30 having an end with a different geometry than end in FIG. 8A, according to an example embodiment.
Figure 8C:
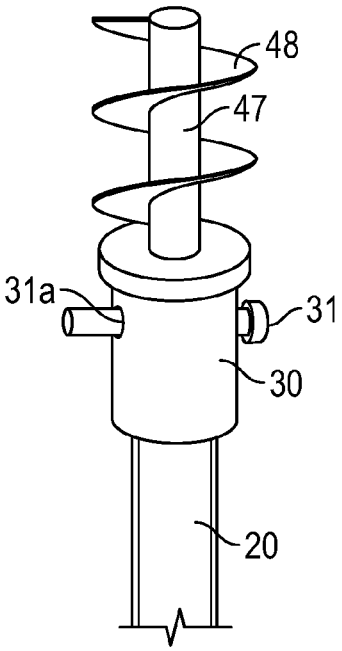
FIG. 8C is a perspective view of clean out tool 30 having an end with a different geometry than in FIGS. 8A and 8B, according to an example embodiment.
Figure 8D:
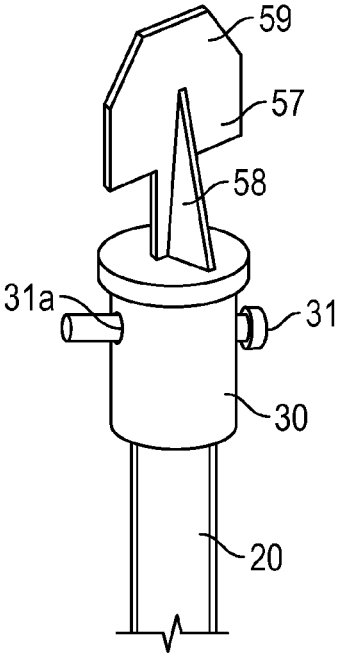
FIG. 8D is a perspective view of clean out tool 30 having an end with a different geometry than in FIGS. 8A-8C, according to an example embodiment.

FIG. 8B is a perspective view of clean out tool 30 having an end with a different geometry than end in FIG. 8A. Triangular end plate 37 comes to a point 39 and includes support 38. FIG. 8C is a perspective view of clean out tool 30 having an end with a different geometry than in FIGS. 8A and 8B. End 47 includes a spiral member 48 that could be used for cleaning a drill head with a spiral shape. FIG. 8D is a perspective view of clean out tool 30 having an end with a different geometry than in FIGS. 8A-8C. Paddle-shaped member 57 has an end 59 with cropped corners and includes support 58.

Figure 8E:
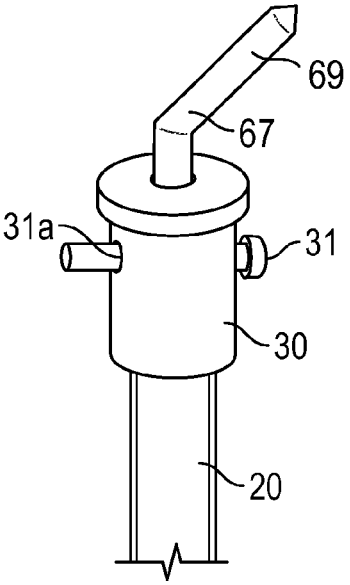
FIG. 8E is a perspective view of clean out tool 30 having an end with a different geometry than in FIGS. 8A-8D, according to an example embodiment.
Figure 8F:
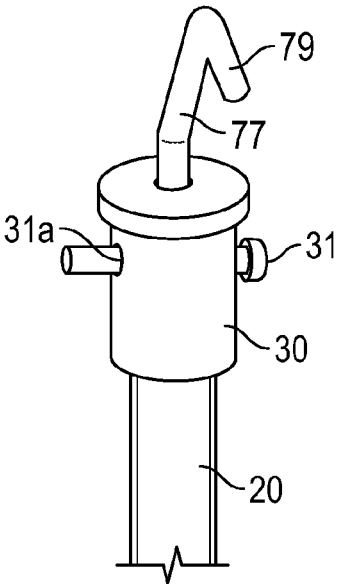
FIG. 8F is a perspective view of clean out tool 30 having an end with a different geometry than in FIGS. 8A-8E, according to an example embodiment.

FIG. 8E is a perspective view of clean out tool 30 having an end with a different geometry than in FIGS. 8A-8D. Extending member 67 includes an angled end 69 that may be useful for cleaning debris from a spiral drill head. FIG. 8F is a perspective view of clean out tool 30 having an end with a different geometry than in FIGS. 8A-8E. Extending member 77 includes a hooked end 79 that may be useful for pulling debris from the interior of a drill head. For example, drill head 130 (shown in FIGS. 2 and 3) could be lowered onto drill head clean out apparatus 10 having a clean out tool 30 with hooked end 79. The drill head 130 could then be raised and the barb on hooked end 79 could serve to pull debris from the interior of drill head 130.

Figure 9:
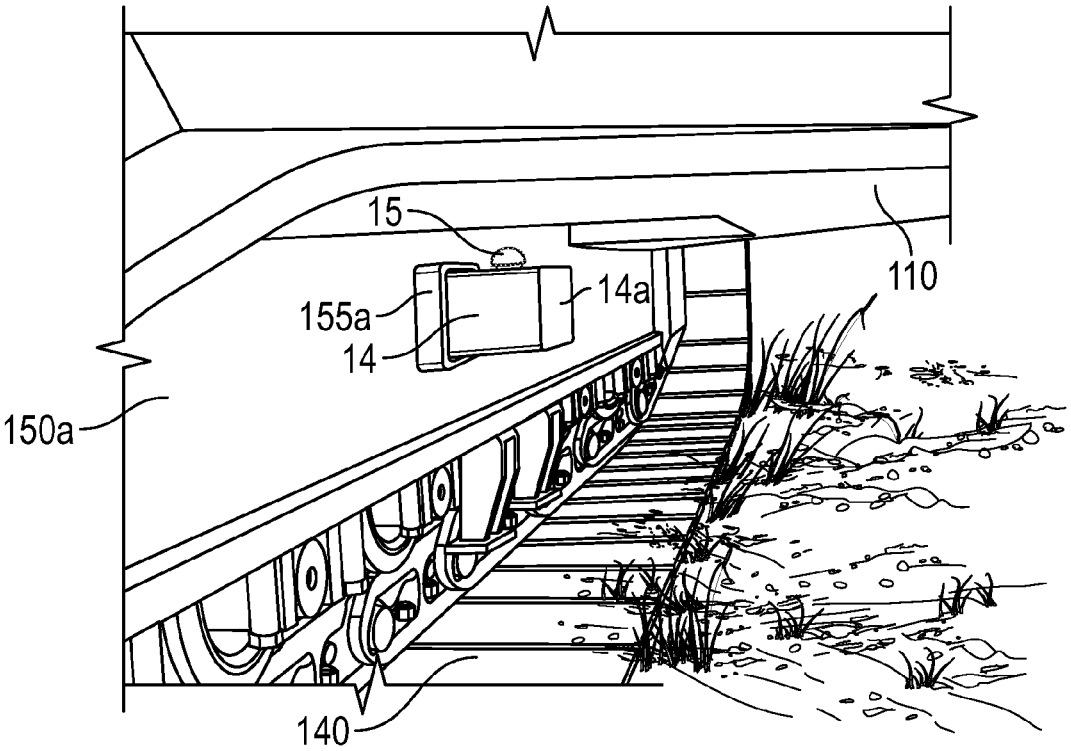
FIG. 9 is a perspective view of bar 14 extending into an undercarriage of drill rig 100 shown in FIG. 7A.
Figure 10:
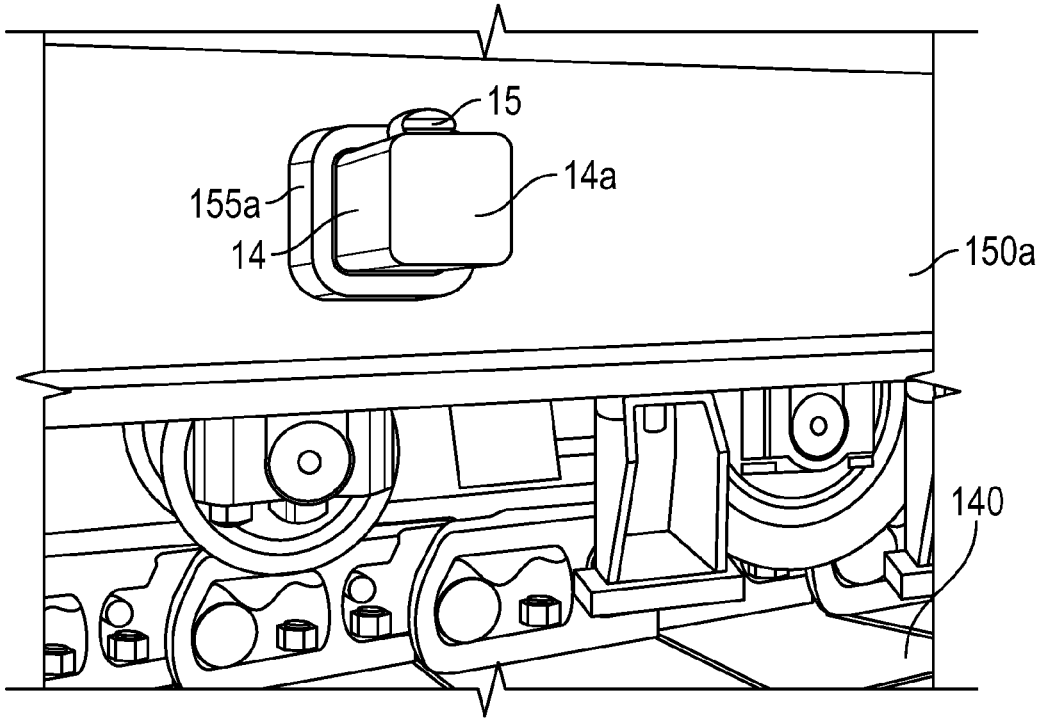
FIG. 10 is a perspective close up view of bar 14 extending into an undercarriage of drill rig 100 shown in FIG. 7A.

FIGS. 9 and 10 are perspective views of bar 14 extending into an undercarriage of drill rig 100 shown in FIG. 7A. In particular, end 14*a* of bar 14 is shown extending through an aperture in end 155*a* of hollow tube 155 (shown in FIG. 7A) that extends through inner surface 150*a* of base 150 (shown in FIG. 7A) above track 140. A pin 15 is positioned in an aperture in bar 14 that serves as a stop to prevent the end 14*a* of bar 14 from exiting base 150 during a clean out operation. A pin could also be placed through hollow tube 155 on the outer side of base 150 and into bar 14 to provide a stop. Other means for preventing the bar 14 from sliding out of the aperture in hollow tube 155 could also be used. For example, a cap could be screwed onto the end 14*a* of bar 14 to serve as a stop.

A method of cleaning out a drill head using the drill head clean out apparatus 10 shown in FIGS. 1-10 may be used where the drill head clean out apparatus 10 is prevented from rotating together with the drill head 130 as the drill head 130 rotates. The drill head 130 may be rotated back and forth during the clean out operation. This method helps to eliminate the downtime caused when debris and/or clay becomes stuck within an interior of a drill head.

Figure 11:
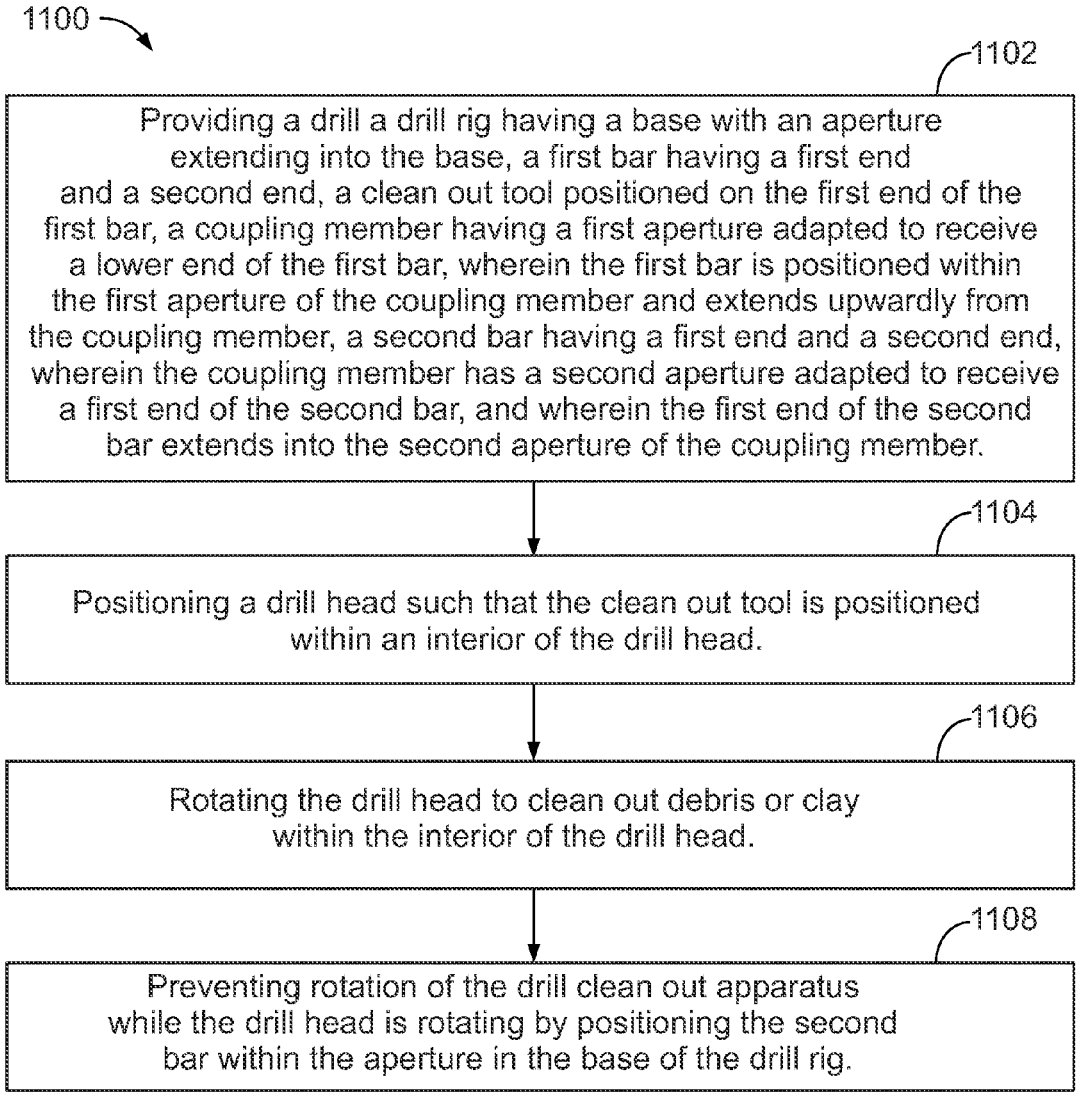
FIG. 11 is a method 1100 of cleaning out a drill head, according to an example embodiment.

The method 1100 shown in FIG. 11 may include the step 1102 of providing a drill a drill rig having a base, with an aperture extending into the base, a first bar having a first end and a second end, a clean out tool positioned on the first end of the first bar, a coupling member having a first aperture adapted to receive the first bar, wherein the first bar is positioned within the first aperture of the coupling member and extends upwardly from the coupling member, a second bar having a first end and a second end, wherein the coupling member has a second aperture adapted to receive a first end of the second bar, and wherein the first end of the second bar extends into the second aperture of the coupling member.

Method 1100 may further include the step 1104 of positioning the drill head such that the clean out tool is positioned within the interior of the drill head, as well as the step 1106 of rotating the drill head to clean out debris or clay within the interior of the drill head, and the step 1108 of preventing rotation of the drill clean out apparatus while the drill head is rotating by positioning the second bar within the aperture in the base of the drill rig.

The method 1100 may further include the step of placing a pin into a hole in the second bar to prevent the second end of the second bar from exiting the undercarriage of the drill rig.

It will be appreciated that the above disclosed embodiments are useful for drilling holes in a landfill. However, the use of drill head clean out apparatus 10 is not limited to drilling holes in a landfill, and may be used anywhere where a hole is drilled and there is a need to clean out the drill head.

Example embodiments have been described above. Those skilled in the art will understand that changes and modifications may be made to the described embodiments without departing from the true scope and spirit of the present invention, which is defined by the claims.

What is claimed is:

1. A drill head clean out apparatus, comprising:
- a clean out tool;
- a first bar having a first end and a second end, wherein the clean out tool is adapted to be positioned on the first end of the first bar;
- a coupling member having a first aperture adapted to receive the first bar when the first bar is in a vertical orientation;
- a second bar having a first end and a second end;
- wherein the coupling member has a second aperture adapted to receive a first end of the second bar when the second bar is in a horizontal orientation;
- wherein the second end of the second bar is adapted to be positioned within an aperture in a base of a drill rig;
- wherein the clean out tool is vertically oriented and adapted to clean out debris or clay from an interior of a circular and hollow drill head; and
- wherein the clean out tool has an upper end that is tapered or rounded such that an uppermost end of the upper end has a narrower width than a portion of the clean out tool supporting the upper end.

2. The apparatus of claim 1, wherein a hole is positioned in the second bar such that a pin may extend into the hole, and the pin is positioned in the hole and rests on top of the coupling member above the aperture to position the clean out tool a desired distance above the ground.

3. The apparatus of claim 1, wherein the clean out tool is removably secured to the first end of the first bar.

4. The apparatus of claim 3, wherein the clean out tool is removably secured to the first end of the first bar by a pin that extends through a bottom portion of the clean out tool and the first end of the first bar.

5. The apparatus of claim 1, wherein the clean out tool comprises a first vertically extending flange supported by a second vertically extending flange positioned perpendicularly to the first vertically extending flange.

6. The apparatus of claim 1, wherein the coupling member is comprised of steel tube having ¾ inch thick walls.

7. The apparatus of claim 1, further including means for preventing rotation of the drill head clean out apparatus when the clean out tool is positioned within the interior of the drill head and the drill head is being rotated.

8. The apparatus of claim 1, wherein the second end of the second bar extends through the aperture in the base of the drill rig.

9. The apparatus of claim 1, wherein the first bar has a square cross section and the first aperture in the coupling member is sized so that the first bar is prevented from rotating within the first aperture when the clean out tool is positioned within the interior of the drill head and the drill head is being rotated.

10. A drill head clean out apparatus, comprising:
- a clean out tool;
- a first bar having a first end and a second end, wherein the clean out tool is adapted to be positioned on the first end of the first bar;
- a coupling member having a first aperture adapted to receive the first bar when the first bar is in a vertical orientation;
- a second bar having a first end and a second end;
- wherein the coupling member has a second aperture adapted to receive a first end of the second bar when the second bar is in a horizontal orientation;
- wherein the second end of the second bar is adapted to be positioned within an aperture in a base of a drill rig; and
- wherein the first end of the second bar is removably secured to the coupling member by a pin extending through a portion of the coupling member extending about the second aperture and into a hole in the first end of the second bar.

11. A drill head clean out apparatus, comprising:
- a clean out tool;
- a first bar having a first end and a second end, wherein the clean out tool is adapted to be positioned on the first end of the first bar;
- a coupling member having a first aperture adapted to receive the first bar when the first bar is in a vertical orientation;
- a second bar having a first end and a second end;
- wherein the coupling member has a second aperture adapted to receive a first end of the second bar when the second bar is in a horizontal orientation;
- wherein the second end of the second bar is adapted to be positioned within an aperture in a base of a drill rig; and
- wherein the second end of the first bar extends all the way through the first aperture of the coupling member, and a base plate is secured to the second end of the first bar.

12. A drill head clean out apparatus, comprising:
- a drill rig having a base, with an aperture in the base;
- a first bar having a first end and a second end;

a clean out tool positioned on the first end of the first bar;

a coupling member retaining the first bar, wherein the first bar extends upwardly from the coupling member;

a second bar having a first end and a second end;

wherein the coupling member retains the first end of the second bar; and wherein the second end of the second bar is positioned within the aperture in the base of the drill rig.

13. The drill head clean out apparatus of claim 12, wherein the first end of the second bar is removably secured to the coupling member by a pin extending through a portion of the coupling member extending about the second aperture and into a hole in the first end of the second bar.

14. The apparatus of claim 12, wherein the second end of the first bar extends all the way through the first aperture of the coupling member and a base plate is secured to the second end of the first bar.

15. The apparatus of claim 12, wherein the clean out tool is removably secured to the first end of the first bar.

16. The apparatus of claim 12, wherein the clean out tool is adapted to clean out debris or clay from an interior of a drill head.

17. The apparatus of claim 16, wherein the aperture in the base of the drill rig is comprised of square tubing that extends from the base of the drill rig.

18. The apparatus of claim 16, wherein the base of the drill rig has a first side wall and a second side wall, and the second bar extends all the way through the aperture in the first side wall of the base of the drill rig into an undercarriage of the drill rig, and the second bar has a hole, adapted to receive a pin that serves to prevent the second end of the second bar from exiting the undercarriage of the drill rig.

19. The apparatus of claim 18, wherein an inner side of the second side wall of the base of the drill rig has an extending flange, and the second bar extends into the undercarriage of the drill rig such that the second end of the second bar rests on the extending flange, thereby allowing the drill clean out apparatus to be stowed near the base of the drill rig.

20. The apparatus of claim 12, wherein the aperture is positioned in a sidewall positioned within a tractor track.

21. A method of cleaning out a drill head, comprising the steps of:

providing a drill rig having a base and a circular and hollow drill head; the base including an aperture; a clean out tool; a first bar having a first end and a second end, wherein the clean out tool is adapted to be secured to the first end of the first bar; a second bar having a first end and a second end where the first end of the second bar is secured to the first bar and the second bar extends horizontally from the first bar; wherein the second end of the second bar is adapted to be positioned within the aperture in the base of the drill rig; and wherein the clean out tool is vertically oriented and adapted to clean out debris or clay from an interior of a circular and hollow drill head;

positioning the drill head such that the clean out tool is positioned within an interior of the drill head;

rotating the drill head to clean out debris or clay within the interior of the drill head; and preventing rotation of the clean out tool while the drill head is rotating by the positioning of the second end of the second bar within the aperture in the base of the drill rig.

22. The method of claim 21, wherein the base of the drill rig has a first side wall and a second side wall, and the second bar extends all the way through the aperture in the first side wall of the base of the drill rig into an undercarriage of the drill rig, and the second bar has a hole adapted to receive a pin, further including the step of:

placing a pin into the hole in the second bar to prevent the second end of the second bar from exiting the undercarriage of the drill rig.

23. A drilling apparatus, comprising:

a drill rig having a base and a circular and hollow drill head; the base including an aperture;

a clean out tool;

a first bar having a first end and a second end, wherein the clean out tool is adapted to be secured to the first end of the first bar;

a second bar having a first end and a second end where the first end of the second bar is secured to the first bar and the second bar extends horizontally from the first bar;

wherein the second end of the second bar is positioned within the aperture in the base of the drill rig; and wherein the clean out tool is vertically oriented and adapted to clean out debris or clay from an interior of the circular and hollow drill head.

* * * * *